United States Patent [19]

Sahley

[11] 4,445,580

[45] May 1, 1984

[54] DEEP HOLE ROCK DRILL BIT

[75] Inventor: Lloyd W. Sahley, Mayfield Heights, Ohio

[73] Assignee: Syndrill Carbide Diamond Company, Cleveland, Ohio

[21] Appl. No.: 393,780

[22] Filed: Jun. 30, 1982

Related U.S. Application Data

[63] Continuation-in-part of Ser. No. 160,860, Jun. 19, 1980, which is a continuation-in-part of Ser. No. 50,088, Jun. 19, 1979, abandoned.

[51] Int. Cl.[3] ..... E21B 10/04; E21B 10/58

[52] U.S. Cl. ..... 175/404; 175/410; 175/413

[58] Field of Search ..... 175/404, 410, 413, 401, 175/403, 405, 406, 412, 413, 327, 333, 346, 393

[56] References Cited

U.S. PATENT DOCUMENTS

| | | | |
|---|---|---|---|
| 874,455 | 12/1907 | Swanton et al. | 175/413 |
| 993,972 | 5/1911 | English | 175/413 |
| 1,479,668 | 1/1924 | Lyle | 175/413 |
| 1,550,088 | 8/1925 | McNeil | 175/413 X |
| 2,022,101 | 11/1935 | Wright | 175/381 X |
| 2,022,194 | 11/1935 | Galvin | 175/382 |
| 2,034,072 | 3/1936 | Wright | 175/387 X |
| 2,039,427 | 5/1936 | Kinzbach | 175/410 X |
| 2,189,040 | 2/1940 | Jones | 175/346 |
| 2,485,098 | 10/1949 | Johnson | 175/324 |
| 2,693,938 | 11/1954 | Roberts | 175/410 X |
| 2,738,166 | 3/1956 | Koch | 175/333 |
| 2,803,435 | 8/1957 | Kammerer | 175/401 X |
| 3,055,443 | 9/1962 | Edwards | 175/333 |
| 3,084,752 | 4/1963 | Tiraspolsky | 175/333 |
| 3,106,973 | 10/1963 | Christensen | 175/413 |
| 3,140,749 | 7/1964 | Dionisotti | 175/410 |
| 3,455,402 | 3/1969 | Tiraspolsky | 175/327 |

FOREIGN PATENT DOCUMENTS

| | | | |
|---|---|---|---|
| 5419 | 5/1879 | Fed. Rep. of Germany | 175/404 |

*Primary Examiner*—Stephen J. Novosad
*Assistant Examiner*—Michael Starinsky
*Attorney, Agent, or Firm*—Yount & Tarolli

[57] ABSTRACT

Rock drill bit having shaving cutters on the leading end of a removable bit head for shaving the hole bottom and shaving reamer cutters extending lengthwise of the bit. The cutters and receiving slots therefor have dovetail configurations for trapping the cutters in the slots. Wedges for locating the cutters are disposed in the bottoms of the slots. Lateral passages communicate with a central mud passage to deliver mud fluid to ports between the cutters. The central mud passage has a venturi configuration and lengthwise extending passages in the bit extend downwardly from upstream of the venturi to intersect or communicate with the lateral passages. A core shaver is mounted by a collet chuck in the central passage close to its outlet to the leading end of the bit to shave a core formed on the hole bottom between the inner ends of the shaving cutters on the end face.

55 Claims, 16 Drawing Figures

DEEP HOLE ROCK DRILL BIT

This application is a continuation in part of applicant's prior copending Application Ser. No. 160,860, filed June 19, 1980 and which was a continuation in part of Application Ser. No. 050,088, filed June 19, 1979, now abandoned.

BACKGROUND OF THE INVENTION

This invention relates to earth boring tools, and more particularly to drills for boring through rock. More specifically, the invention relates to rock drill bits especially adapted to deep hole drilling.

There is an increase in world demand for mineral sources of energy, particularly oil and gas. Economic and political considerations have made it expedient, as well as profitable, to explore much deeper formations not only for these hydrocarbon sources of energy but also for geothermal sources of energy. While world needs today are basically being supplied with wells which are at the most 10,000–12,000 feet deep, it has now become necessary to drill for these commodities to depths which may reach in excess of 30,000 feet. Accordingly, a "deep hole" as the term is referred to in the present specification will be understood as one which is greater than about 12,000 feet deep.

The physical properties of the shallower wells currently being exploited are quite different from those experienced when the hole is over 12,000 feet. Temperature increases and the compressive strength of rocks increases as the hole depth deepens and this presents problems at depths above 12,000 feet and particularly difficult problems at depths of over 18,000 feet. Generally the drilling speed is a deep hole decreases significantly with increase in depth. The pressure and compressive strengths prevailing at such depths causes rolling impact type drilling tools such as rotary one drill bits to lose their effectiveness, and the bit teeth begin to "track" in their own pounded impression at the bottom of the hole. The bit teeth no longer fracture and gouge the rock. In deep holes, the rock has been measured as having compressive strengths of 100,000–180,000 psi and requires shearing or shaving forces to effect drilling, rather than roller cone drill bits which operate by compressive fracture means.

Furthermore, in rock formations at lesser depths conventional rotary cone drill bits will often cut oversize because of soft rock formations and the blast nozzles action of the mud flow. However, as the depth increases in hard rock the borehole tends to close behind the drill because of the earth overburden pressure and causes drill withdrawal problems.

Another serious problem encountered with the rotary type drill bits in attempting to drill a "deep hole" involves the load of the drill string on the bit. In drilling a "deep hole" it is common to bore the first portion up to about 100 feet in depth with an earth auger at a diameter of 20–24 inches. A liner is then put in the bore to this point and cemented between the liner and the earth by conventional means. Thereafter a 17-inch diameter three roller cone type bit may be used to penetrate clay and soft sand. This type of drilling will proceed for approximately another 1,000 feet depending on the nature of the rock whereupon the bore is again lined with a suitable steel liner and cemented in. The bit diameter may then be reduced to approximately 13 inches for the next 4,000 feet. As the depth increases, the diameter of the bit is continually stepped down, for example, to a 6½ inch diameter bit for the ultimate depths, e.g., up to 25,000 feet. Reduction in the size of the bit necessitates a reduction in the size of the bearings in the roller cones supporting the weight of the drill string above. At such extreme depths, the load of the drill string can reach and exceed two million pounds. Although counterbalanced, impact often puts the full load of the drill string on the bearings. While the bearings should be getting larger to withstand the increasing loads, they are, of necessity, made smaller. In addition, in geothermal wells, corrosive chemicals usually found in such wells rapidly destroy rotary cutting bearing materials.

In addition, roller cone type bits and diamond bits require a shock absorber accessory when drilling. Such an accessory is necessary as the rock gets deeper and harder because of the chattering of the bit when fracturing the rock.

A further problem encountered with known drill bits is that caused by the difficulty in fracturing hard rock close to or on the axis of the drill bit. Because of this, some bits have been provided with core breakers. However, the core breakers wear and blunt thereby providing problems in deep hole drilling.

As indicated above, the plastic nature of the hard rock formation at such deep hole depths results in a closing in of the sidewalls of the bore. A decrease in diameter of as little as 1/32 of an inch in deep holes may be sufficient to prevent return of the drill to the surface. The close-in occurs in a very short time, for example, starting in seconds and continuing to within about 3 minutes of passing through a given level. Thereafter, the flow of the rock inward closing the bore holes usually stabilizes. Accordingly, it is essential to ream immediately after drilling.

Prior structures have involved the positioning of reamers and non-cutting drill stabilizers along the drill string at spaced levels to allow the stabilization of the formation between the drill bit and to maintain the diameter of the hole to permit withdrawal of the drill bit as this becomes necessary.

Another problem encountered in deep hole drilling is the thickening of the mud fluid because of loading with rock cuttings and suspension solids. Drilling muds usually contain some dispersed solids initially, e.g., bentonite clay, to aid in the dispersion of rock cuttings from the hole bottom and additional suspension solids are added as the drilling deepens the hole. The nature of such cuttings is important to the ability of the drilling mud or slurry to remove such cuttings efficiently. With conventional tri-cone bits, cuttings may be too large to be suspended and carried up outside the drill pipe and mud weights may reach 17 pounds per gallon, rather than a preferred 9 to 11 pounds per gallon. This requires high energy pumps and greatly increased pumping pressures to lift the solids from the bottom of the hole.

Another problem experienced with prior art deep hole drilling structures has been the tendency of such drill bits to deviate from a true line, particularly upon encountering an off center force such as a geologic fault or tilted geological formation. As the drill enters such a fault or tilt, the resistance to descent on one side of the drill head is increased on the one side over what it is on the opposite side; and accordingly, the direction of the drill head is easily diverted, usually to head into the tilted rock face at 90 degrees to the face. Rotary cutter type drill bits are particularly subject to wandering from the predetermined bore line.

Another problem in drilling relates to field servicing of the drill head. It is common practice for a driller to estimate the number of drill bits which will be required for a given bore and to order a supply for replacement. Once a drill bit has been removed from the end of the string, it is usually returned to the manufacturer for servicing or reconditioning at a remote site instead of at the drilling site.

Prior bits for deep holes have also included diamond studded drills wherein diamonds are embedded in a suitable metal matrix to form an abrasive or grinding surface for cutting through rock of the type one experiences at great depths as in a deep hole. Difficulties are experienced with such diamond bits when the weight of the drill string becomes excessive. At such heavy loads, the diamonds fracture and when this happens, the drill head soon loses its effectiveness. Such diamond studded drill bits are extremely expensive.

The present invention represents an improvement on prior structures. There are no bearings in the improved structures of the present invention, and consequently the improved drill bit is better able to withstand the excessive loads imposed by both drill string and the drill mud at extreme depths. In addition, cutters including end cutters for shaving the bottom face of the hole are mounted in a secure manner without the use of screws or welding.

The problem of "rock creep close-in" can be overcome with the structures of the present invention since a suitable length of cutters functioning as reamers is provided to maintain the diameter of the bore for a sufficient period of time after the drill head has passed a given bore depth to overcome any tendency of the drill bit to become locked in against removal. Because of the structure of the devices of the present invention, there is less tendency for the bit to wander from a predetermined bore path and specific designs are readily provided when wandering is a serious problem as in the case of tilted geological formations. Still further, the drill bits of the present invention are easily serviced in the field. In geothermal exploration, the improved bits hereof are not as susceptible to damage by corrosive materials. The structure of the rock cutting elements not only makes them readily replaceable, but enables the cutters to be adjusted to accommodate variations in the nature of any rock encountered by the drill bit. The cutters may also be adjusted in the field to account for wear on the cutters.

The front rake angles of the cutters are critical for chip formation, cutters with proper rake angles can easily be installed. Negative front rake angles normally produce fine powdery grain chips of 50 to 200 micron size. Zero front rake angles produce small rock chips like flakes. Positive rake angles up to 12 degrees inward from center will, for example, produce chips up to $1\frac{1}{2}''$ diameter by $\frac{1}{8}''$ thick in an 8" diameter drill bit.

Still further, the structures of the present invention enable improvement in the specifications for the drilling mud whereby the overall column weight may be adjusted favorably for suitable removal of the products of drilling.

An advantage over the prior art structures afforded by the present invention is that the torque for cutting through rock is, at deep levels, reduced over that which is required for diamond drills and rotary cutting drills. Accordingly, power requirements are reduced. Still further, the structures of the present invention are adjustable to maintenance of the diameter of the bore even though the cutter elements experience wear in the course of boring.

Vibration, which loosens bolts and threaded locking screws for holding the cutter elements in the historical bit utilizing such elements, does not affect the structures of the present invention which depend on a wedge system.

A further advantage of a bit in accordance with the present invention is the facility with which bits may be repaired, serviced, or changed on the drilling site, including bit changes necessitated by a change in the geological formation being drilled or merely because of the depth of the hole.

The drill bit of the present invention enables higher drilling speeds, particularly in deep holes, including holes of over 18,000 feet. Moreover, the advantages of on-site service and maintenance of the bit and higher drill speeds render the bit useful in drilling at less than 12,000 feet.

BRIEF STATEMENT OF THE INVENTION

One aspect of the present invention lies in a drill bit with shaving type end cutters in the form of bars which are arranged about the axis of the drill bit, extend crosswise of the bit axis, and project outwardly of the leading end of the drill, the end cutters being mounted and secured by a wedge system so as to be removably secured against vibrating loose. In the preferred structure, dovetail shaped end cutters are disposed in slots having a dovetail configuration for receiving the cutter and securing means in the form of wedges are provided behind the cutters to force them outwardly of the slots toward the hole bottom to securely trap the cutters between the holding wedges and the dovetail configuration of the slot.

In another aspect of the invention, cutter bars functioning as reamers are located in axially extending slots opening into the circumferential periphery of the drill bit with the slots and cutters having a dovetail configuration for trapping the cutters in the slots, there being securing means in the form of wedges behind the cutters to forcing the latter outwardly of the slots to force the cutters toward or against the dovetail side walls of the slots. Further, wedges for adjusting the widths of the dovetail configurations of the reamer slots, may be used to adjust the extent of projection of the cutters from the slots by changing the wedge. The configuration of the side wedge may also be used to control the slot dovetail configuration to acommodate various dovetail shaped cutters to vary the angle of the cutting surface of the cutter.

The cutter bars functioning as reamers preferably project for substantially the full length of the drill bit and include bevelled cutting surfaces adjacent the top of the drill bit so that the drill may easilly drill its way out of a closed in hole on withdrawal of the drill string.

A further aspect of the invention is a drill bit in which the end cutters leading the bit are inclined in a manner to cut a conically shaped hole bottom, either concave or convex, to better control drift caused by tilted geological formations to facilitate drilling relatively soft formations, respectively.

A feature of the invention is that for cutting hard rock the end cutters are arranged to cut an annulus about a central core and a core cutter is positioned in a chamber behind the cutter which opens into the central part of the end face of the drill bit to receive the core being formed, the core cutter having end cutting surfaces and preferably side cutting surfaces and preferably being disposed in a chamber forming a central mud passage through the drill bit. Such a core cutter is, in the preferred embodiment, held in the central mud passage by a collet chuck which is formed to provide passages for the mud between its outer periphery and the sidewall of the control mud passage and is otherwise configured to provide minimum turbulence in the flow past the collet chuck.

A further feature of the invention is the provision of a flow divider for the mud which enables the pressure to the ports to be maintained relatively close to maximum and enables substantially full mud flow to each cutting face. Also, the divider is relatively non-turbulent to provide effective washing and cleaning of the cutting faces. In the preferred embodiment, a central mud passage of the drill bit includes a restriction, preferably formed by a venturi configuration in the mud passage. This maintains a pressure head in the portion of the mud passage upstream of the venturi. Additional lengthwise extending passages for distributing mud from the central mud passage to ports between the reamer cutters and to ports between the end cutters on the lead end face of the drill bit intersect the central mud passage upstream of the restriction. In addition, passages extend upwardly and outwardly from the central mud passage to mud ports spaced around and lengthwise of the drill bit with one group of ports having passages, intersecting the mud passage adjacent the restriction.

In the preferred embodiment, the drill bit has a body and a removable head with the latter supporting end cutters and remaing cutters which interlock with the end cutters to lock the latter against endwise movement out of the end cutters receiving slots. Spacer members may be used between the end cutters and reaming cutters to cooperate with the cutters in securing the end cutters against movement outwardly of their slots.

Preferably the drill bit is in the form of a drill body and a bit head, the bit head having an internally threaded bore which threads onto an externally threaded projection of the drill body to mount the bit head as the nose of the drill bit and crosswise extending cutter bars arranged about the bit axis on its leading end face for shaving the bottom face of the hole and reamer bars which extend preferably for a substantial axial length of the drill bit.

BRIEF DESCRIPTION OF THE DRAWINGS

The invention may be better understood by having reference to the annexed drawings illustrating a preferred embodiment of the present invention, and wherein.

DETAILED DESCRIPTION OF THE DRAWINGS

Figure 1:
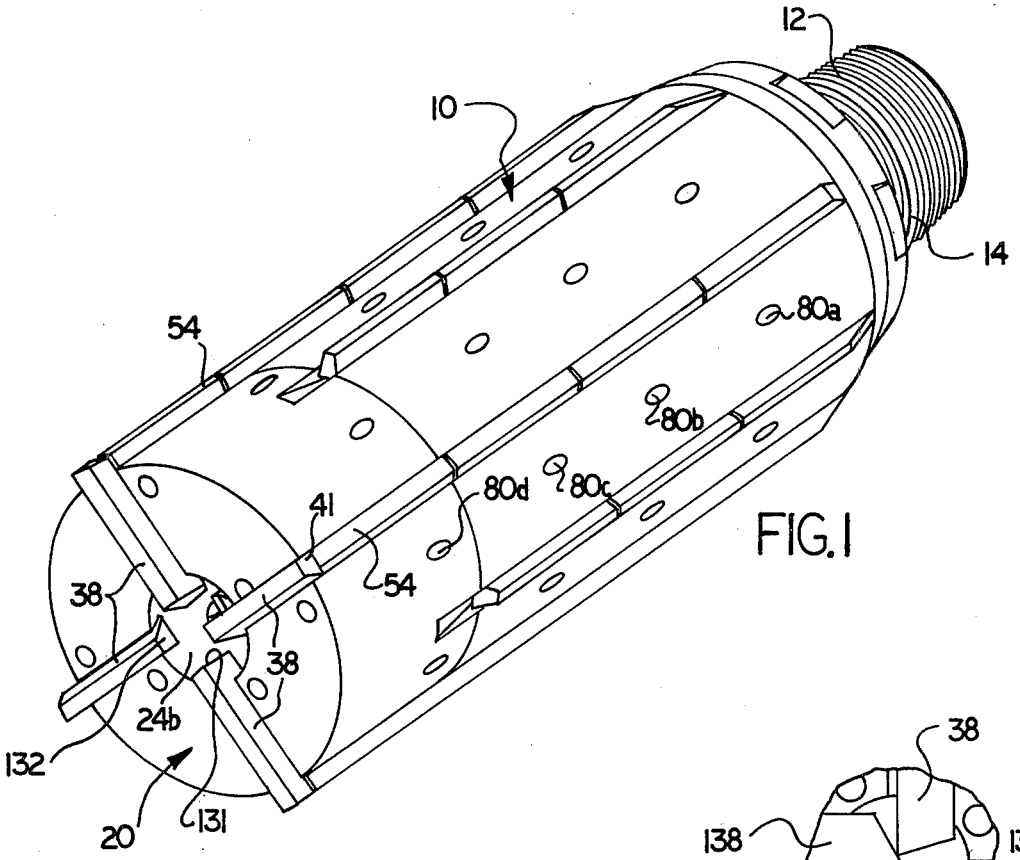
FIG. 1 is a pictorial view of the drill bit embodying the present invention.
Figure 2A:
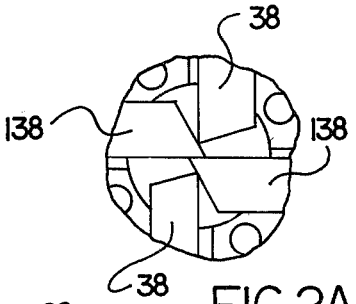
FIG. 2*a* is a view showing a different bit arrangement.
Figure 2:
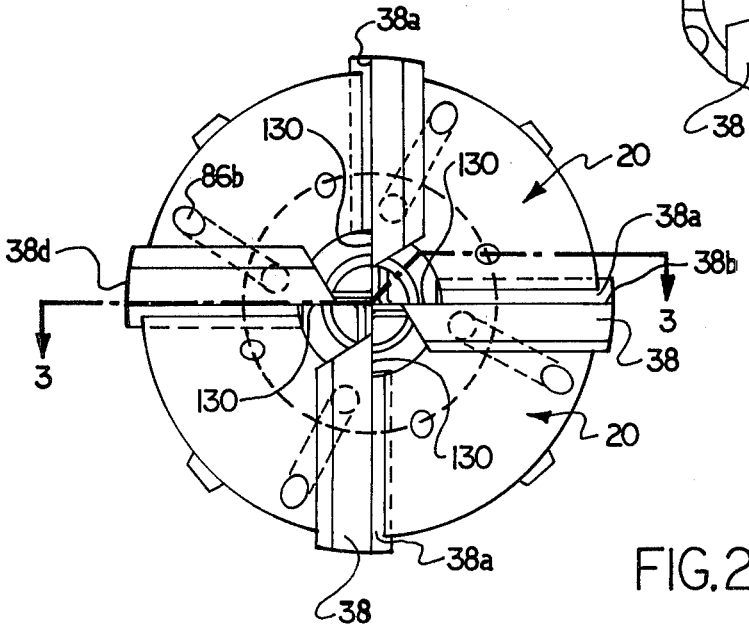
FIG. 2 is a bottom plane view of the drill bit of FIG. 1.

Referring now more particularly to FIGS. 1 and 2, there is here shown a preferred embodiment of the present invention. The rock drill bit of the present invention includes a generally cylindrical drill body 10 having a reduced top end 12 adapted for attachment to a drill string as, for example, by a threaded portion 14 thereof. The lower end of the drill body 10 is also provided with a reduced threaded projection 18 for mounting of a bit head or nose 20. The bit head 20 has a maximum diameter equal to the maximum diameter of the body 10 and forms, when assembled thereto, a continuation of the outer periphery of the drill body. In general, the drill body 10 has a longitudinal or axial extent which is about 3 to 4 times the axial extent of the head 20 to increase drilling trueness and stability.

It is preferred to form the body 10 of a double drawn SAE 4150, or equivalent heat treated steel having a hardness of from 50 to 55 on the Rockwell C scale. This material is tough enough to prevent high torque on the head 20 from destroying the threaded portion 18, and to prevent ripping out of cutters under heavy cutting loads.

The bit head 20 has an internally threaded bore 22 opening into its upper end which threads onto the male threaded portion 18 projecting from the drill body. The threaded connection is such to cause the head 20 to fit against an annular horizontal shoulder 23 on the drill body at the base of the reduced threaded portion 18, preferably a gasket 23*a* is disposed between the bit head 20 and the drill body to facilitate release of the bit head for removal.

The drill has an axial central mud passage 24 extending therethrough formed by a central passage 24*a* through the drill body and a central passage 24*b* in the drill head. For purposes to be explained hereinafter, the passage 24*a* has a restriction therein. In the preferred embodiment the restriction is formed as a venturi with the sidewalls of the passageway portion 24*a* tapering inwardly from the top of the drill bit to the narrow point 24*c* of the venturi which is about one-third to one-half the length of the passage from the lower or lead end of the drill body 10. The passage 24*a* then tapers outwardly from the narrow point to the bottom of the drill body end. The passage 24*b* where it opens into the bore 22, has a diameter slightly smaller then the diameter of the bottom of mud passage 24*a* but is in axial alignment with the latter and has sidewalls which diverge from the top to the outer leading face of the bit head.

Referring to FIGS. 1 and 2, the leading end of the drill head 20, mounts a plurality of end cutters 38 in the form of cutter bars having a generally dovetailed or trapezoidal configuration. The cutters extend crosswise of the axis and are angularly spaced around the axis of the drill bit.

Figure 3:
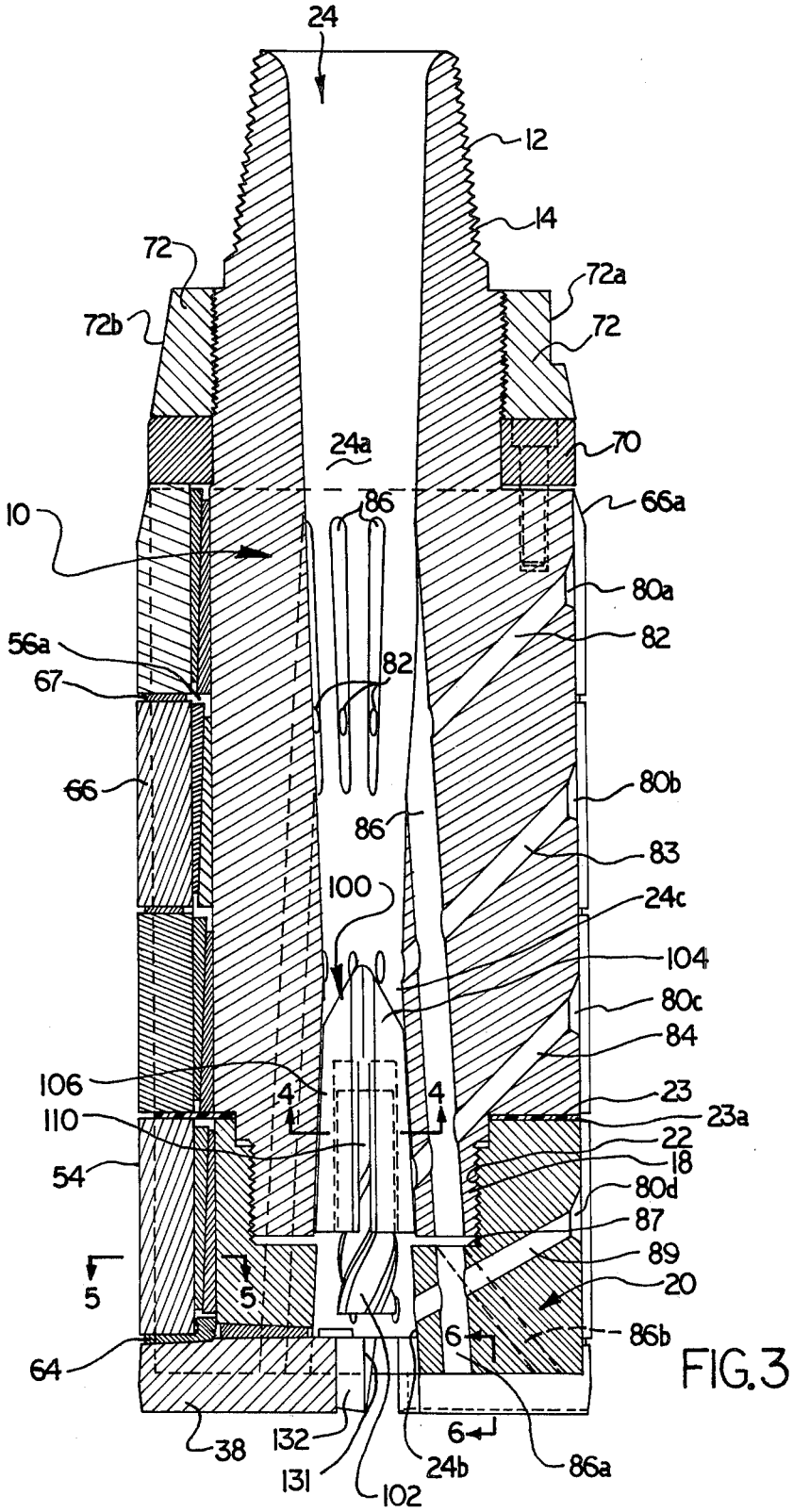
FIG. 3 is an offset sectional view taken along line 3—3 of FIG. 2.

In the embodiment of FIG. 1 there are four end cutters located about 90 degrees from each other. Each of the end cutters 38 is positioned in an individual slot 40 opening into the leading end face of the bit head as is best shown in FIGS. 1 and 3. The slots 40 have a dovetail configuration for receiving the cutters formed by sidewalls 41 (see FIG. 6) which diverge from the end face of the bit head to bottom shoulders 42 of the slot. These shoulders join the sidewalls of the dovetail configuration to the sidewalls of a recessed bottom channel 45. The bottom channels 45 project inwardly of the bit head from the shoulders 42. The slots 40 including the bottom channels 45 extend from the mud passage **24*b*** to the outer periphery of the bit head. The slots including the bottom channels are open at their ends adjacent the outer circumference of the bit head and at the central mud passage.

In operation, the drill bit of FIGS. 1, 2 and 3 rotates in a counterclockwise direction as viewed in FIG. 2. The cutters are shaving cutters and the leading side **38*a* of each of the cutters projects from the cutter slot and terminates in a working or severing edge 38*b* at the corner of the leading or front side and the outer side or top of the cutter. The leading side 38*a* functions as the cutting surface. The slots 40 in the bit head are disposed such that the severing edge 38*b* is positioned along a radius of the drill head. In the embodiment of FIG. 1, there are four cutters 38, two of which have cutting edges 38*b* on opposite sides of the axis lying along one diameter with the other two having their cutting edges 38*b*** lying along a diameter perpendicular to the first diameter.

The cutters 38 are each wedged against the diverging sloping sides of respective slots by means urging the cutters outwardly of the receiving slots. In the preferred embodiment, wedges 47 are positioned in the bottom channels of the slots to extend for substantially the full length thereof and are forced into the slot between the slot bottoms and the bottoms of the cutters to securely trap the cutters between the dovetail configurations of the slot and the wedges in the slots. For wedging action, the bottoms of the bottom channels preferably slope outwardly from the drill and away from the end face so that the bottom of the channels are in planes which are at a small angle, e.g., 2 degrees to 4 degrees, to a plane perpendicular to the drill axis. This provides a wedge angle on the bottom for cooperating with the wedge inserted behind the end cutter, the wedge having a corresponding wedge angle.

When assembling the end cutters to the bit head, the end cutters are slid into the dovetail configuration of the bottom slots from the outer ends of the slots. Wedges are then forced into each recessed bottom channel 47 between the bottom of the bottom channels and the bottoms, i.e., innermost sides of the cutters, to force the cutters against the sloping sidewalls of the slots. It will be noted that the top or outermost side **38*c* of each cutter 38** is a clearance face which slants upwardly from the plane generated by the cutting edge to provide a top rake angle behind the cutting edge which may typically be 2 degrees-3 degrees.

Figure 6:
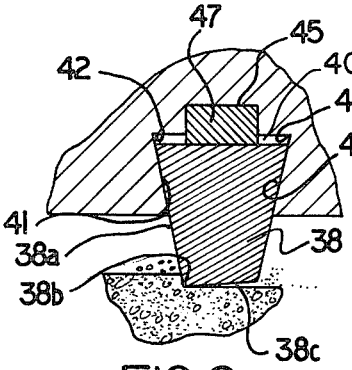
FIG. 6 is a fragmentary cross-sectional view taken along line 6—6 of FIG. 3.
Figure 6A:
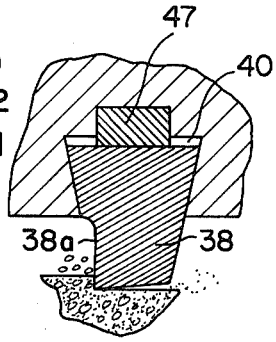
FIGS. 6*a* and 6*b* are views corresponding to FIG. 6 showing different cutting elements being used.
Figure 6B:
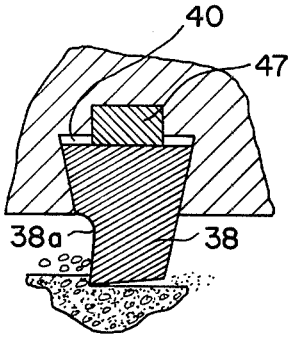

In the cross sectional view of FIG. 6, the leading cutting side **38*a* of the cutter lies in a plane which provides the cutter with a negative rake angle for the cutting surface. A negative rake angle is one where the portion of the surface 38*a* at the leading edge 38*b* is inclined from the leading edge in the direction of cutting as is shown in FIG. 6. If the surface of the leading side 38*a* extends from the cutting edge in a direction away from the direction of cutting, the angle is said to be a positive rake angle as shown in FIG. 6B. FIG. 6A** illustrates a 0 degrees rake angle, i.e., neither positive nor negative. The less positive the rake angle of the cutting surface, the finer the chips. Accordingly, as the negative rake angle increases or the positive angle becomes less the chips becomes finer and vice versa.

It will be understood that the top rake angle of the top side which extends along the bottom being cut is provided with a rake angle which provides the necessary clearance behind the severing edge so as to prevent rubbing of the top of the cutter on the hole bottom.

The end cutters 38 have outer end faces **38*d* which intersect with the severing face 38*a* to provide the gauge diameter cutting edge 38*e* of the tool. This edge controls the cut diameter or "gauge diameter" of the borehole. As the drill bit rotates the outer cutting edge of cutter bar 38 cuts the initial bottom hole opening to the driller's gauge diameter. The end face 38*d*** is curved away from the diameter gauge edge at a radius sharper than the radius set by the diameter gauge edge.

If the gauge diameter of the cutter bars wears down and produces a smaller diameter bottom hole, the reamer cutter bars 54 in the drill bit head 20 will cut the borehole to its full gauge diameter. If the deep hole further closes in due to creep-flow, the following reamer bars 66 will further ream the borehole to its proper gauge diameter.

The bit head is also provided with axially extending reamer cutters 54 in the form of cutter bars. The reamer bars having cutting edges **54*c* extending the length of the bars corresponding to the cutting edges of the end cutters. The cutting edge is formed by the intersection of a severing face 54*b* and a relief face 54*c*. The reamer cutters are preferably received in slots 56** spaced from each other about the circumference of the bit head and extending the entire length thereof parallel to the axis of the bit head, with the lower ends of the slots communicating with a corresponding end cutter slot in the leading end of the drill bit head.

Figure 5:
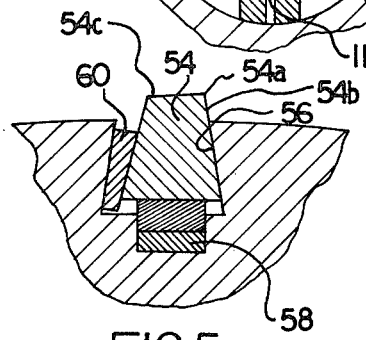
FIG. 5 is a fragmentary section taken along line 5—5 of FIG. 3.
Figure 5A:
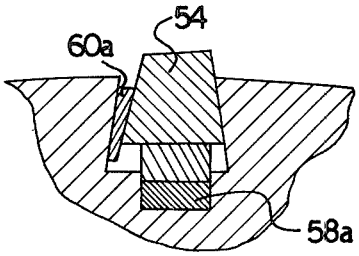
FIG. 5*a* is a view corresponding to FIG. 5 but showing cutting elements adjusted for wear.

The slots 56 for the reamer cutters are illustrated as having essentially the same type of dovetail and bottom channel configuration as the slots for the end cutters 38 and wedges 58 are utilized in the bottom channels to force the reamer cutters against the sloping sidewalls of the slots or side wedges forming the dovetail configuration. Preferably two opposite tapered wedges are used. Wedges 60 are preferably utilized in conjunction with the reamer cutters to vary the width of the dovetail slot so that the projection of the cutter from the slot may be adjusted by changing the thickness of the side wedge and the height of the bottom wedges. Referring to FIGS. 5 and 5A, the bit head is shown in fragmentary cross section to illustrate the configuration of the slots for receiving the reamer cutters and the manner of adjustment for wear of a cutter. It will be noted that the reamer cutter shown in FIG. 5 has a side wedge 60 which is thicker than the side wedge **60*a* for the reamer cutter shown in FIG. 5A. The reamer cutter in FIG. 5A is the same one as shown in FIG. 5 but become worn. Because of wear in height, the wedge in slot 56 has been replaced with a thinner wedge 60*a*** to allow the cutter to move outwardly of the slot to compensate for the wear.

The top wedge 58 has also been changed to a thicker wedge to effect wedging of the reamer cutter outwardly.

Preferably, the end cutters have a step 62 (see FIG. 7) formed in the top of the outer end of the end cutters for receiving the lower end of the reamer cutter disposed above the end cutter. A spacer 64 (see FIG. 3) is preferably provided between each reamer cutter on the bit head and the respective end cutters if engagement of the two cutters, if carbide, would create a cracking problem. If desirable, the spacer may have an upwardly extending leg which engages the inner wall of the notch and extends upwardly behind the lower reamer cutter in the slot in the bit head to interlock the reamer and end cutters.

The drill body 10 is also provided with reamer cutters extending along the length of the body at angularly displaced locations about the body. As illustrated in FIG. 1, the reamer cutters 66 in the drill body are received in slots 56*a* extending the length of the drill body, part of which align with the ends of the slots for the reamer bars in the bit head 20. In the embodiment of FIG. 1, there are twice as many reamer bar slots in the drill body as there are reamer cutters in the bit head 20 and accordingly, every other reamer bar slot in the drill body 16 does not align with a reamer slot in the bit head. Preferably, the reamer bar slots in the drill body are spaced equidistantly upon each other about the circumference of the drill body. The reamer bars and slots of the drill body will not be described in detail since they essentially correspond with the reamer bars and slots therefor in the bit head. Suffice it to say that a plurality of reamer cutter sections are utilized in each slot in the drill body as illustrated in FIG. 3 and spacers 67 may be utilized between the ends of the reamer cutters in each slot. The topmost reamer bar section is provided with a bevel 66*a* at its top end to enable the top reamer sections to ream out a hole which has closed in behind the drill to enable the pulling of the drill bit to withdraw it from the hole.

The number of reamer sections in each slot 56*a* will be determined by the rate of "close-in" of the bore hole as the drill bit of FIG. 1 proceeds down hole. If the "close-in" can be stabilized quickly, fewer cutter sections are required. If a longer period is required to stabilize the wall of the bore, then a larger number of cutter sections will be required. When less than a full number of cutter sections is utilized, noncutting stabilizing fillers dimensioned to slide into the dovetail slots may be used to fill up the unused balance of the dovetail slots.

As will be apparent from the foregoing, the reamer cutter 66 in alternate slots in the drill body are held against downward movement by the reamer cutters 54 in the bit head. The reamer cutters which are not aligned with the reamer cutters in the bit head are held against downward movement by the top of the bit head or by a decreased depth of reamer slot adjacent the bit head. The reamer cutters in the drill body are clamped downwardly by a clamp ring 70 which has an internal diameter to allow it to pass over the reduced upper end portion of the drill body as the latter is viewed in FIG. 3 and to clamp against the top ends of the top reamer cutters in the reamer slots of the drill body. The clamp ring is held against the top end of the reamer cutter by bolts 71 which thread through the ring into the drill body. A locking clamp 72 is threaded onto the reduced end portion to bear against the clamp ring 70. Preferably, tack welds are also used between the clamp nut and clamp ring, the welds being such that they can be easily broken for disassembly.

Thus, the best locking action of the wedges for the various shaving cutters described have been obtained when the following parameters are observed. The locking surfaces of the wedge must be accurately machined, and roughened either during machining or subsequently to a surface finish of approximately 100 to 150 rms microinch. The angle of the wedge should be between 2 degrees to 4 degrees. The hardness of the steel should not exceed 45 Rockwell C and should not be less than 40 Rockwell C.

The locking surfaces of the drill body and bit head which engage the wedge surfaces also should be similarly roughened to the same hardness. Also, the bottom wedge contacting surfaces of the cutters 38 and 66 used on the drill bit should be similarly roughened.

If tungsten carbide cutters are used, these surfaces should be left as molded and sintered, i.e., approximately 80 to 120 rms surface finish.

In addition to the central mud passageway 24 through the drill bit, the drill body is provided with a series of mud ports between adjacent reamer slots. As illustrated in FIG. 1, there are three such mud ports 80*a*, 80*b*, 80*c*, between each of the reamer slots with the mud ports being aligned lengthwise of the drill body along lines midway between the adjacent reamer slots. The mud ports in each series are in communication with the central mud passageway 24 by drilled passages 82, 83, 84, which extend downwardly and inwardly from the ports 80*a*, 80*b*, and 80*c*, respectively, as illustrated in FIG. 3. It is understood that the number of passages 82 correspond to the number of ports 80*a* and that the passages are spaced angularly about the drill body. This is also true for the drilled passages 83, 84 and their ports 80*b*, 80*c*. It is understood that the number of mud ports can be varied as required by rock formations.

In addition to the drilled passages 82, 83, 84, there are a group of drilled passages 86, one passage for each series of mud ports 80*a*, 80*b*, 80*c*. The passages 86 open into the central mud passage a short distance below the clamp ring 70. Each drilled passage 86 lies in the same axial plane as the drilled passages 82, 83, 84 for a series of mud ports 80*a*, 80*b* and 80*c* and therefore intersect with those passages.

It will be noted that the drilled passages 82 each intersects the corresponding lengthwise extending passage 86 at the area of the latter's intersection with the central mud passage and about halfway between the throat of the venturi portion of the mud passage and the clamp ring 70. Each drilled passage 83 intersects the drilled passage 86 which lies in the same axial plane and then the mud passage in the drill body immediately above the throat 24*c* of the venturi, and the drilled passages 84 intersect the corresponding drilled passages 86 in the corresponding planes and then the central mud passage 24 at a location below the throat of the venturi and adjacent the lower end of the drill body. The drilled passages 82, 83, 84 form a series of circularly arranged ports in the central mud passage at the described locations.

The generally axially extending passages 86 diverge downwardly and outwardly from the axis of the mud passage 24*a* and open into the lower end of the drill body, which is the outer end of the male portion 18. When the bit head 20 is in place, there is a space between the bottom of the internally threaded bore 22 of the bit head and the male portion 18 to provide a mud distribution chamber 87. This distribution chamber distributes mud to lengthwise extending passages 86*a* in the bit head. The passages 86*a* extend from the bottom of the internally threaded opening 22 to the leading end face of the bit head.

When the bit head is positioned on the drill body with the reamer slots aligned with the reamer slots of the drill body, the drill passages 86*a* perform a continuation from the chamber 87 of corresponding ones of the drilled passages 86 in the drill body. In the illustrated embodiment (FIG. 3), there are four such drilled passages 86*a* which open into the leading end of the bit head to form a circularly arranged series of ports, one adjacent the leading face of each cutter bar close to the mud passage 24*b*.

The bit head 20 also has a series of drill passages 86*b* which extend from ports in the leading end face close to the outer circumference thereof inwardly to the chamber 87 so that they open into the chamber 87 generally opposite to alternate ones of the drilled passages 86 in the drill body when the bit head is positioned on the drill body with the reamer cutter slots aligned. This outer series of mud ports provided by the passages 86*b* are located adjacent the trailing sides of the end cutters. Accordingly, the end cutter bars have a mud port adjacent their leading edge but located close to the inner end portions of the end cutters and a mud port disposed adjacent the trailing edge, but close to the outer end portions. In other words, the ports adjacent the leading side of the end cutters are at a shorter radius from the center of the bit head than are the ports adjacent the trailing sides of the end cutters.

While the drill bit has been described with reamer bars on the bit head being in alignment with reamer cutters on the drill body, it will be understood that the alignment is not necessary. If the reamer cutters on the bit head are out of alignment with the reamer cutters on the drill body, the reamer cutters on the drill body will bottom against the upper end of the bit head and the reamer cutters on the bit head will abut a lower peripheral portion of the drill body. The chamber 87 will form a mud distribution chamber for distributing the mud to the passages 86*a*, 86*b* in the bit head.

In addition to the passages 86*a*, 86*b* opening into the leading end of the bit head, the bit head also has drilled passages 89 corresponding in number to the passages 86*a*, 86*b* and which extend upwardly from the mud passage 24*b* in the bit head to intersect the outer circumference of the bit head 20 at ports 80*d* each of which is in alignment with one of the series of ports 80*a*, 80*b* and 80*c* when the bit head has its reamer cutters aligned with those on the drill body. Each passage 89 intersects one of the passages 86*a*, 86*b*. This provides two ports 80*d* between each of the reamer bars on the bit head with the spacing of a port 80*d* from its adjacent reamer bar being one-half the spacing between the ports themselves.

Figure 4:
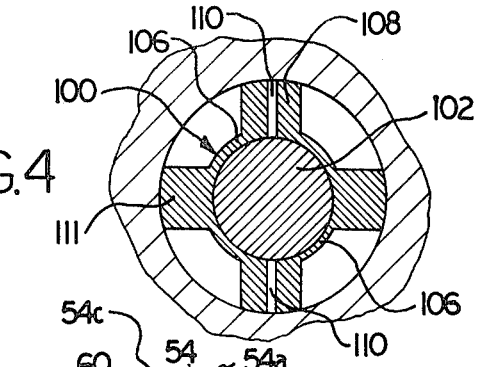
FIG. 4 is a sectional view taken along line 4—4 of FIG. 3.

The drill of the present invention is also provided with a core cutter. Referring to FIGS. 3 and 4, a collet chuck 100 for holding a core cutter 102 is positioned in the lower end of the mud passage 24*a* of the drill body. This is the portion of the mud passage where the sidewall thereof diverges outwardly from the axis of the passage on the downstream side of the venturi throat. The core cutter 102 is a shaving type and is held by the collet chuck 100 along the axis of the drill body. The core cutter extends from the collet chuck downwardly into the central mud passage 24*b* of the bit head and terminates in the mud passage 24*b* but is close to the end cutters.

Referring to FIGS. 3 and 4, the collet chuck 100 has a tapered base portion 104 and two collet grippers 106 extending outwardly from the base portion for gripping the cutter 102. The chuck is formed with four flutes 90 degrees apart. Two of the diametrically opposed walls of the flutes 108, 111 have slots 110 therein extending from the base portion 104 to the opposite end of the flutes to provide the collet grippers. The collet chuck is made of resilient bronze and the natural angle of diversion of the collet grippers is substantially the same as the divergence of the sidewall of the central passage 24*b* in which the collet chuck is received. During assembly, the core cutter is placed inside the collet chuck and the collet chuck is tapped into the lower end of the mud passage 24*a* until a secure fit is obtained.

During drilling the forces of drilling will tend to wedge the collet chuck more tightly into the central mud passage and tighten its grip on the core cutter. Bronze has proved to be a good performing metal for the collet chuck. The bronze collet chuck is internally reamed so that it accurately fits the core cutter. This fit, together with the bronze material in a slow taper, for example $4\frac{1}{2}$ degrees of the collet grippers, enables a core cutter of solid sintered tungsten carbide to be used without breaking along the shank due to high clamping pressures.

Figure 8:
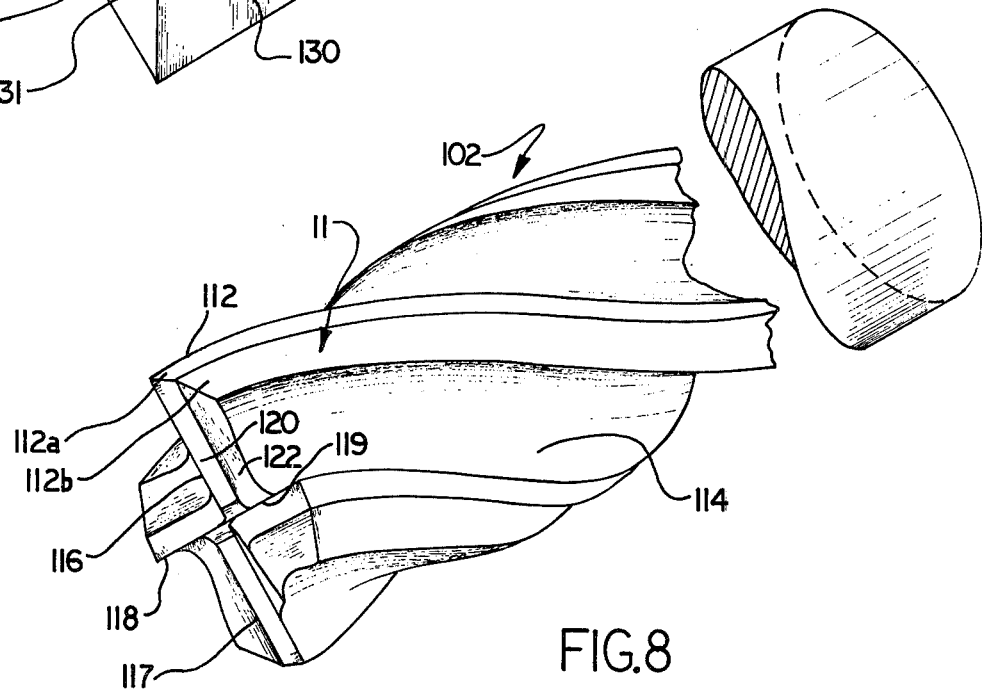
FIG. 8 is a fragmentary view of a core cutter used in the drill bit of FIG. 1.

As is best shown in FIG. 8, the core cutter is formed with a shank section at one end and a fluted section at the other end. The fluted section has helical flutes which provide helical walls and valleys between the walls. The top of the walls have self-sharpening helical edges and cutting edges 112 extending about the axis of the cutter. Each wall has a surface 112*a* extending from its cutting edge 112 at a rake angle, and to join a backoff clearance surface 112*b* which extends to the sidewall of the valley at an increased rake angle. The cross section of the helically fluted part of the cutter is uniform throughout its length and the cutter has a uniform maximum outside diameter throughout its length.

The outer end of the fluted section is ground to provide cutting edges for shaving a core. These edges extend inwardly from edge 112*a* of the walls to provide cutting edges 116, 117, 118, and 119 disposed in quadrature with each other. These cutter edges 118 and 119 for shaving the top of the core lie along a common diameter of the cutter and each extends to the axis of the cutter. The cutting edges 116 and 117 for shaving the top of the core also lie along a common diameter but extend inwardly to just short of the axis of the cutter. The outer end of the cutter is further ground to provide a first rake sufrace 120 extending away from each of the edges 116, 117, 118 and 119 and a second surface 122 which extends from the surface 120 to the sidewall of the flute to provide backoff clearance. In addition, each surface 120 associated with the cutting edges 116 and 117 in a relief surface 126 adjacent to the axis to provide clearance for the shaving edges 118 and 119 to extend to the axis.

Figure 7:
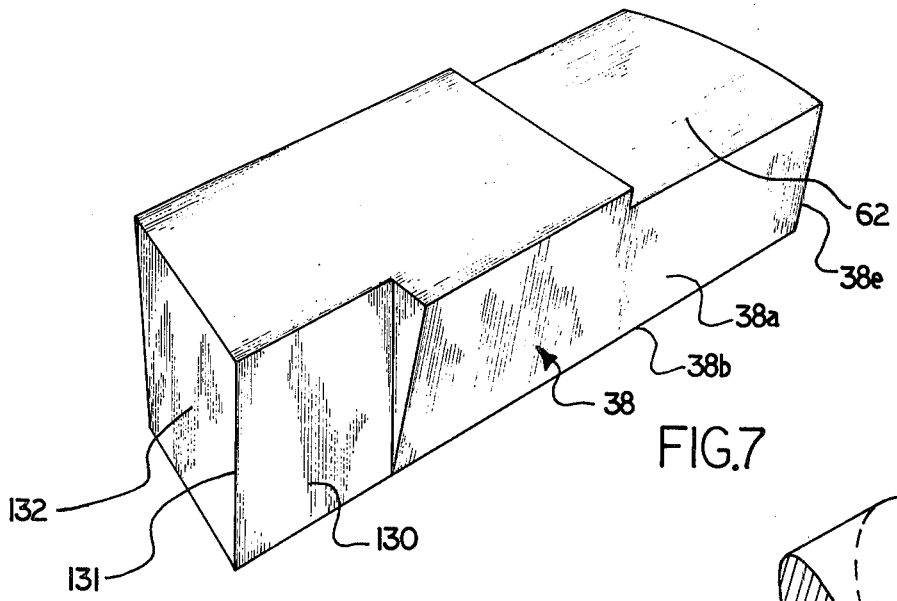
FIG. 7 is an orthogonal view of an end cutting element used in the drill bit of FIG. 1.

As shown in FIG. 7 the end cutters 38 have an inner portion 130 which underlies the outlet opening of the central mud passage of the bit. Inner end portions 130 of the cutters are formed so that the leading side 38*a* of each is recessed to provide a positive rake angle for the shaving edge 38*b* on the inner portion 130. In addition, the edge 131 of the leading side on the portion 130 forms a shaving edge for forming the core. The inner end face 132 of the cutter is inclined relative to the leading face 38*a* for backoff purposes.

The inner ends of the end cutter 38 are spaced from each other so that the cutting edge 131 form a cylindrical core as the drill bit feeds. The top of the cylindrical core, while still attached to the bottom face of the rock borehole, will then be engaged by the core cutter 102 (upon achieving the necessary height) to shave the top of the core. The cuttings and breaking of the core will be washed away by the mud flow through the venturi.

As shown in FIG. 8 and described, the core cutter 102 has certain differences from a metal working end mill which it resembles. An end mill must be resharpened by grinding faces 116, 117, 118, and 119. End mills generally have thickening web cross sections for greater strength.

Usually in diamond drill bits cores are formed and then broken by wedge shaped core breakers because of the center cutting problem (there is no rotational speed at the centerline of the bit). Bits usually begin failing at the centerline in harder rock. The wedge shaped core breakers flatten off from wear, thus causing the bit to "ride" and cease penetrating, since a flat thrust bearing has been created inside the bit.

The concept of the core cutter shown in FIG. 8 is that if the core cutter is shaving a continuously fed core stub by the bit, the wear on the cutter will be equal on all its faces 120, 122, 112*a*, 112*b*, 116, 117, 118, 119, 120 and 122. Also flute 114 should wear at the same rate as the cutting end and outer diameter of the cutter. A test of a one-inch diameter tungsten carbide core cutter running for 16 hours in Sierra while granite, Texas Pink granite, and carthage marble revealed about a $\frac{1}{4}''$ loss from the cutting end of the cutter. In addition, since the same cross section of the cutter is maintained, the cutter did not wear to a blunt end, as is experienced with wedge core breakers. The cutter resharpened itself due to the abrasive action of the rock which thereby converted a difficult wear force to useful purpose, because apparently the fluted tool cross-sectional configuration and fluting directed the flow and the paths of the rock particles as they were being cut to a uniform rubbing or abrading action on all cutter contacting surfaces.

In FIG. 3 upon wearing off 1" of the cutting end length of a new 1" diameter core cutter, 4" overall length with 2" of fluting 114, a plug of the same length as the wear, is inserted behind the core cutter 102, to bring the lead cutting edges 116, 117, 118, and 119 back to the same position lengthwise on the axis of the drill bit directly behind cutters 38.

The configuration of the collet chuck 106 for the core cutter is designed to minimize the obstruction to the mud flow through the venturi section 24*b*. The conical base portion of the collet chuck 104, first encounters the mud flow at its apex, which has been rounded to provide a spherical surface at the apex. The mud flow then divides around the conical surface equally with a minimum of turbulence. The mud fluids then pass through four passageways formed by the flutes in the chuck. Fluid also passes through slots 110 along the axis. The mud fluids then flow along the outer diameter and flutes 114 of core cutter 102 and wash away all rock cuttings, chips and broken cores. The mud flow then washes behind cutter bars 38, and washes away cuttings on surfaces 130 and cutting edges 138.

The internal diameter of the mud passage 24*b* at the bottom of bore 22 is slightly smaller than the outside diameter of the outer end of the chuck 100. Also the cutters 38*a* are normally positioned so that the inner ends thereof underlie the core cutter. Each of these arrangements provides protection against the core cutter and/or the collet chuck from being blown into the borehole being drilled by a sudden surge in mud pressure.

Figure 9:
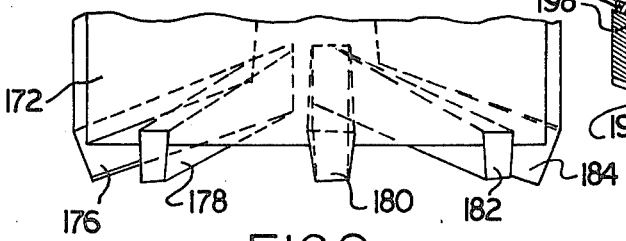
FIGS. 9 and 10 show modified arrangements and structures for the bit head of the drill bit of FIG. 1.
Figure 10:
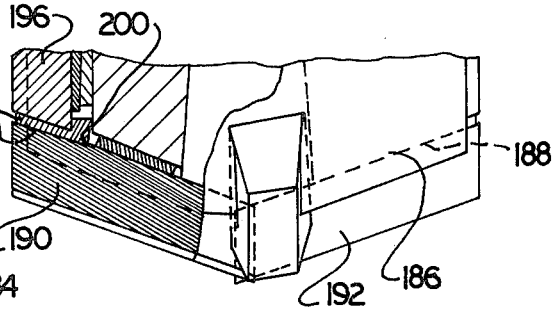
Figure 9A:
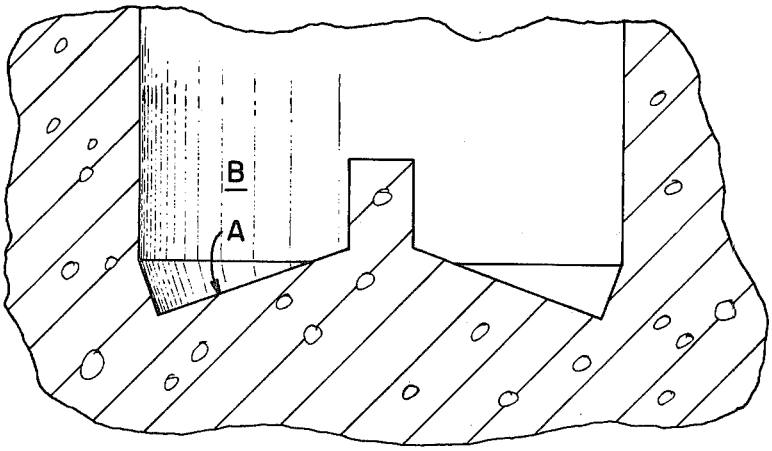
FIG. 9A shows the cross section of the bottom of a rock hole cut by the bit shown in FIG. 9.

It will be understood that in the embodiment described, the end cutters 38 at their severing edges 38*a* rotate in a plane perpendicular to the axis of the drill head. It will also be appreciated that the leading end of the bit head may be given a conical configuration either an obverse conical configuration as illustrated in FIG. 9 or an inverse conical configuration as illustrated in FIG. 10. Referring more particularly to FIGS. 9 and 10, such modifications of the bit head are shown. The only changes in these modifications from that of FIG. 1 occurs in the head portions. Thus, in FIG. 9 there is shown a modified head portion 172. In this embodiment, the leading end of the bit is concavely conically shaped. Radiating dovetail slots are provided at 45 degrees intervals and end cutter bars, such as cutter bars 176, 178, 180, 182 and 184 are shown. In all other respects, the nose portion 172 is the same as the head portion 20 shown in FIG. 1. This bit head is utilized for drilling in tilted geological formations. As shown in FIG. 9A the bit produces a bottom hole face A for drill hole B as shown in FIG. 9*a*. The dashed line illustrates the tilt of the formation.

When the drill bit is being used in soft or medium hard rock which is frangible and which crumbles when sheared off as chips by the cutters, it is possible to use a bit arrangement as shown in FIG. 2*a*. This arrangement permits the bit to run without a core cutter on the central axis of the bit as shown in FIG. 2. In the cutter arrangement in FIG. 2*a*, two cutters 38 are used opposite each other at 180 degrees, are set with their inner ends off the centerline of the bit and two cutters 138 of the same construction as cutters 38 but are of longer length and are made so that cutting edge 131 is beyond the centerline. By setting cutters 138 so that they are positioned in the wedge slots at 90 degrees from the two cutters 38 and 180 degrees to each other, and extending the cutting body and faces beyond the centerline so that the inner end of the cutter overlap each other as shown in the drawing, the cutting action of the drill bit effects a clean bottom hole from the outer diameter of the hole to the centerline of the bit. No core is formed in this configuration. Since this configuration on cutter 138 actually causes that part of surface 130 and cutting edge 131 of cutters 138 to be traveling backwards beyond the centerline where the cutters overlap, this arrangement is not satisfactory for very hard rock, which tends to break off the cutting edge 131 on cutters 138. In soft and medium rocks, however, the arrangement shown in FIG. 2*a* is generally advantageous in that cuttings to the centerline are made with no teat or nub of rock left which might jam the bit's downward penetration by being fed into mud chamber 24*b*. The open venturi flow behind the cutters. FIG. 2*a* will clean the cuttings adequately.

Figure 10A:
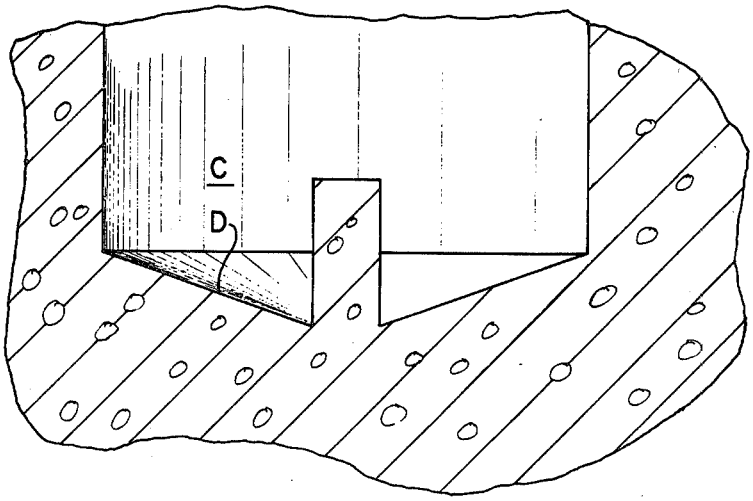
FIG. 10A shows the cross section of the bottom of a rock hole cut by the bit shown in FIG. 10.

FIG. 10 shows another deep rock drill bit in accordance with the present invention wherein the head portion 186 has a leading end which is convexly conically shaped and provided with dovetail slots such as the slot 188 and into which suitable cutter bars, such as the cutter bars 190, and 192 are disposed in the same manner as previously described. As shown in FIG. 10, a reamer cutter 196 is interlocked by an L-shaped a locking separator 197 with the end cutter 192 at a notch 198 provided in the confronting surface of the end cutter 192. The separator engaging the shoulder of the notch 198 prevents radial outward movement of the cutter bar 192. In like manner the radial end cutters in the head portions 172 and 20 shown in FIGS. 8 and 1, respectively, may also be locked into position against radial outward movement and dislodgement from the respective bit head by an L-shaped separator. The bit head of FIG. 10 drills a hole with a bottom face configuration D as shown in FIG. 10*a* and is used at high speed drilling in soft formations.

It will be observed that the different configurations of the drill heads or nose portions enable selection of a particular nose portion configuration for the best drilling in various rock formations. The change from one structure to another can be quickly made once the drill is lifted from the hole. The bit head 20, and the bit heads of FIGS. 9 and 10 may be formed of double drawn heat treated SAE 4150 steel treated to a Rockwell C hardness of from 50 to 55. This provides sufficient toughness to inhibit ripping out of the cutter bars due to excessive torque. As cutters wear, there is no need to send the drill bit off-site for servicing.

The cutter bars whether of the axial cutter bar type or the radial cutter bar type are preferably formed of sintered tungsten carbide. Such sintered tungsten carbide cutter bar elements are formed by the process described in U.S. Pat. Nos. 1,549,615 and 1,721,416 to Schroter. These sintered tungsten carbide elements contain a matrix metal selected from Group VIII of the Periodic Table. A preferred matrix metal is cobalt, and sintered tungsten carbide cutter bar elements containing from about 5% to about 25% by weight of cobalt are suitable for use in accordance with the present invention.

Mud flow characteristics of this drill bit are excellent. As the column of mud fluid enters the end of bit bore passage 24, the radiused top end of the mud passage provides a minimal turbulence as mud fluids enter the venturi bore. The mud column is choked down slightly increasing its velocity without a sharp change in mud pressures. At approximately one third of the length of the tapering venturi to the throat of the venturi the mud flow reaches elongated ports formed by the intersection of the lengthwise extending passages 86 with the central passage 24*a*. The flow divides here into a central column and into passageways 86, eight in the illustrated embodiment. The mud flow in the central column then reaches the tapered cone section of collet 100 and flows thereby as previously described. The mud flows through the passageways 86 to the chamber 87 and then through passages 86*a*, 86*b* to wash the end cutters 38.

The intersection of drilled passages 82, 83, 84, 89 with the central mud passage at the locations previously described and the upward inclination to their corresponding mud ports 80*a*, 80*b*, 80*c*, and 80*d* results in maintaining good pressure and mud flow at and from the ports 80*a*, 80*b*, 80*c* and 80*d* with the mud moving upwardly along the drill body. The passages 83 which intersect the central mud passage 24*b* at the throat of the venturi operating under low pressure and mud flow but this appears to promote the mud fluid from the other ports and the maintenance of maximum flow through at a given pressure. The loss of mud flow volume in one test delivered 375 g.p.m. to the starting end of the venturi 24, and the loss was 50 g.p.m. for a net flow of 325 g.p.m. The small angle (less than 5 degrees) intersection of mud passageways 86 with the central mud passage minimizes mud fluid disturbance by providing several spaced long gradual openings into the central mud passage. Upon removal from the hole, the bit head only may be removed by using a large monkey wrench to turn the bit head off the drill body without removing the latter from the drill string. The reamer cutters may be used as the wrenching surfaces. Ultimately, the bit head may be provided slots 200 for receiving steel blocks to provide the wrenching surfaces.

After the bit head is removed the bottom wedge for the reamers 54, i.e., the ones which engage the bottom of the slot are hit on their exposed ends to drive them downwardly into a space at their lower ends and above the cutters 38. This releases the locking action of the wedges and frees the reamers for removal.

Upon the removal of the reamer at its outer end, each end cutter 38 can be removed by hitting the inner end of the wedge 47 to drive it outwardly of the bit head circumference. An impact bar may be angled through the mud opening to engage the wedge and the outer end of the bar hit with an impact hammer.

The reamer cutters 66 on the drill body may be removed in the same manner as the reamer cutters 54. It will be noted that there is a space between each set of adjacent wedges for adjacent reamer sections to allow the wedges to be hit at their ends to release the reamer sections in sequence.

To remove the drill bit from the drill string, wrenching flats 72*a* on the locking clamp 72 may be used to thread the drill off the drill string by threading out the threaded portion 14 from the string. Rotation of the locking clamp 72 on the drill body is prevented by tack welds between it and the clamp ring 70.

It will be noted that the lock clamp 72 has an inward and upward taper 72*b* on its outer periphery to guide the drill bit inside ledges or shoulders which may be encountered in the bore hole on withdrawal.

It is advantageous for the leading end portion of the bit to be formed of a high strength metal for supporting the end cutters and leading reamer bars or cutters. For example, a steel alloy metal having a tensile strength of about at least 200,000 psi within its elastic range is preferably utilized for drilling difficult formations. Referring to FIG. 1, at least the drill head 20 should be formed of such high strength metal.

The use of high strength metal as described enables high clamping forces to be obtained which are evenly distributed along the clamping surface portions of the cutters or reamers and their corresponding slot walls and wedges.

The forces which are developed when using a high strength metal, as described, for supporting the end cutters and the leading reamer cutters are such that these should be wedged in simultaneously in a step-wise manner. When setting the end cutters and leading reamers, all leading reamers, end cutters and their wedges should be initially finger set in their proper locations. Then all the wedges should be tapped in sequence to partially set them with this being repeated until all wedges are fully set. This may take as many as 10 or 15 repeats. Otherwise, the full setting of certain cutters or reamers may interfere with the full setting of the others. This is because of the spring forces which are set up in the drill head of high strength metal when a cutter or reamer is full set to develop high clamping forces. As the wedges are driven, the cutters or reamers will move outwardly against the spring action of the high strength metal to establish high clamping forces, e.g., 200,000 to 300,000 psi. The outward movement of a cutter or reamer may be gauged to determine uniformly of setting and whether the desired set has been achieved. The outward movement of the cutters or reamers should not be such that the slot for any of such does not open sufficiently to destroy the clamping action.

Preferably, the wedge angles are such to provide the maximum locking effect: 2½ degrees is preferred and the wedge angles should not exceed about 6 degrees.

In the embodiment of FIG. 1, the reamer slots in the bit are preferably rotated 45 degrees about the bit axis from those illustrated to provide access to the wedges of the end cutters when the leading reamers are in place. In such a configuration, the leading reamers may protrude from the leading end of the bit a short distance so as to protect against rubbing on the end face during drilling.

If the reamer slots in the bit of FIG. 1 are not rotated to provide access, the direction of slope of the wedge angle on the bottom of the slots may be changed and the wedges driven in from centrally of the bit providing there is sufficient access to insert and drive the wedges for the end cutters.

In the absence of a separate drill head for the leading end of the bit, rotation of the reamer slots away from the end slots may be done to provide access to the lower end of the reamer slots for setting the lowermost reamers first. The remaining reamers can be set after setting the lowermost reamers and end cutters in the manner described.

It has also been found that it is preferable for the reamers and cutters to have the leading side wall of the cutter or reamer which forms the severing face of the cutter and its corresponding slot wall to extend at 90 degrees relative to the end face of the bit. Also, it is preferable for the leading side wall of the reamer slot lie in an axial plane of the bit. Thus, the slots for the end cutters and reamers would have a single dovetail, the reamers and end cutters being correspondingly configured. In the case of reamers, the side shims for adjusting the outward projection of the reamers would be located between the dovetailed slot wall and the reamer.

In any case, the included angle for the leading and trailing sides of the cutter or reamers and their slots should not be less than about 10 degrees nor more than about 15 degrees, 10 degrees to 12 degrees being preferable, when carbide cutters or reamers are being used. This is true regardless of whether a single dovetail, as described immediately above, or a double dovetail as shown in the drawing is utilized.

It has also been found that it is advantageous to use a pinned wedge to provide the bottom surface of the end cutter slots and against which the driven wedge will operate to wedge the end cutter home.

What is claimed is:

1. A rock drill bit rotatable about an axis for drilling a hole, said bit having a central passage therethrough and a leading end, a plurality of dovetail configured slots opening into said leading end, and said slots being arranged angularly about said central passage and extending laterally from said central passage to the outer periphery of the bit, a plurality of first cutters with a dovetail configuration disposed in said slots with each projecting outwardly of said bit in a generally axial direction to a shaving edge extending radially of said axis for shaving rock from the hole bottom on rotation of said drill bit, the cutters and their shaving edges extending from said passage laterally to the outer periphery of said bit and outwardly thereof, each of said slots having wedging means received in the bottom of the slot for wedging the cutter therein to trap the dovetail configuration of the cutter between the bottom of the slot and the dovetail configuration of the slot to securely lock the cutter in the slot during operation of the bit.

2. A rock drill as defined in claim 1 wherein said cutters each have a leading severing face projecting of its slot and an outer relief side intersecting with said severing face to provide said shaving edge.

3. A rock drill bit as defined in claim 1 wherein said cutters have portions which extend inwardly of said central passage and terminate in a shaving edge which extends generally axially of the bit for shaving a hole core which is received in said mud passage.

4. A rock drill bit as defined in claim 3 wherein the severing face of each cutter has a positive rake angle on said portions and a nonpositive rake angle on the remainder of the severing face.

5. A rock drill bit having a body rotatable about an axis for drilling a hole, said body having a leading end with an end face, a plurality of elongated first cutter bars having substantially planar bottom sides mounted on the leading end of the body to extend outwardly of the leading end face for operating on the bottom of the hole, a plurality of slots opening into the leading end face and having side walls which converge toward the leading end face of the bit for receiving and supporting said cutter bars, said cutter bars and slots being arranged angularly about said axis and said slots extending laterally thereof to open into the outer periphery of the body to provide for insertion of said cutter bars into the slots, said cutter bars being configured to provide side walls converging in a manner corresponding to the convergence of the side walls of the slots with the cutter bars projecting outwardly of the leading end face of said bit and having leading severing faces terminating in edges along lines extending crosswise of said axis for drilling against the hole bottom, said slots having wedge members disposed therein and movable into and out of said slots through the openings of the slots into the outer periphery of the body, said wedge members having surfaces cooperating with the bottoms of the slots and the bottoms of the cutter bars in the slots to wedge the cutter bars outwardly of the slots to trap the cutter bars between the bottoms of the slots and the converging side walls of the slots to hold the cutter bars in the slots during operation of the bit.

6. A rock drill bit as defined in claim 5 wherein said cutter bars each have a leading severing face projecting from its said end face and intersecting an outer relief side of the cutter bar at said edges.

7. A rock drill bit as defined in claim 5 wherein said cutter bars comprise coring cutter bars having portions which terminate in a shaving edge which extends generally axially of the bit for shaving a hole core.

8. A rock drill bit as defined in claim 7 wherein the leading severing face of each coring cutter bar has a positive rake angle on its said portion and a nonpositive rake angle on the remainder of the severing face.

9. A rock drill bit as defined in claim 5 or 7 wherein said cutter bars comprise cutter bars each of which has an outer severing gauge edge extending parallel to the bit axis for shaving the wall of the hole and defined by the intersection of the leading severing face of the cutter bar and an outer end relief surface thereof which extends away from the guage edge at a radius sharper than the radius of the hole to provide a relief surface.

10. A rock drill bit as defined in claim 5 wherein said bit has a central mud passage and first passages communicating with said central mud passage and opening into said leading end face for washing said cutter bars.

11. A rock drill bit as defined in claim 10 wherein there are first ones of said first passage which open into said leading end face adjacent the leading severing faces of said cutter bars and second ones of said first passages which open into said leading end face adjacent the trailing sides of said cutter bars, with said first ones of said first passages being disposed toward the inner ends of the cutter bars and the second ones of said first passages being disposed toward the outer ends of the cutter bars.

12. A rock drill bit as defined in claim 10 in which said central passage has a venturi restriction therein and said body has lengthwise extending second passages extending at a shallow angle to the axis of the bit and intersecting said central passage upstream of said venturi restriction in the upper part of said body, said lengthwise extending passages having communication to communicate with said first passages for delivering mud to the leading end face of the body to wash said cutter bars.

13. A rock drill bit as defined in claim 5 wherein a plurality of reamer cutter bars extend parallel to the bit axis and are mounted in spaced locations about the axis and on the periphery of the bit to project outwardly thereof for shaving the wall of the hole, and a plurality of laterally extending first passageways communicate with said central passage and open into the outer periphery of said bit between adjacent ones of said reamer cutter bars, and a plurality of second passageways extend from the upper part of said central passage toward the leading end of the bit to communicate with mud outlets in the leading end of the bit, said second passageways intersecting said first passageways.

14. A rock drill bit as defined in claim 13 wherein each one of said first passageways intersect a respective one of said second passageways extending from the upper part of said central passage downwardly toward the leading end of the bit to communicate with mud outlet passages in the lead end of said bit, said central passage having a venturi configuration with a throat downstream of the intersections of said second passageways with said central passage, and said first passageways extending downwardly from the periphery of the bit to said central passage.

15. A rock drill bit as defined in claim 14 wherein a first group of said first passageways intersects said second passageways adjacent their intersection with the central passage at first circularly spaced locations about the bit axis.

16. A rock drill bit as defined in claim 13 wherein a first group of said lateral first passageways communicate with said central passage at circularly spaced first locations and said central passage has a venturi configuration with a throat downstream of said circularly spaced first locations.

17. A rock drill bit as defined in claim 16 wherein others of said first passageways each intersect with said central passsage at circularly spaced locations about the bit axis adjacent the throat of said venturi configuration and downstream thereof.

18. A rock drill bit as defined in claim 17 wherein said first passageways extend downwardly from the periphery of said bit to said central passage.

19. A rock drill bit as defined in claim 13 wherein said body has a body section mounting at least a pair of said reamer cutter bars and a removable bit head mounting said first cutter bars and at least a pair of said reamer cutter bars, said second passageways being in said body section and the part of said central passageway in said body section opening into a chamber between said body section and bit head, said bit head having first passages extending from said chamber to locations adjacent the leading edge and trailing edge of each of said first cutter bars to deliver mud fluid to wash said first cutter bars.

20. A rock drill bit as defined in claim 19 wherein said second passageways extending from the upper part of said central passage downwardly toward the lead end of the bit to communicate with said first passages in said bit head.

21. A rock drill bit as defined in claim 20 wherein a first group of said first passageways intersects said second passageways at first locations circularly spaced about the bit axis and at the intersection of the first passageways with said central passage.

22. A rock drill bit as defined in claim 21 wherein said central passage has a venturi configuration with a throat downstream of said first circularly spaced locations and in said body section.

23. A rock drill bit as defined in claim 22 wherein second and third groups of said first passageways each intersect with said central passage at circularly spaced locations about the bit axis with the second group intersecting at the throat of said venturi restriction and said third group intersecting downstream thereof and in said body section.

24. A rock drill bit as defined in claim 5 comprising a body section and a removable bit head on said body section for mounting said first cutter bars.

25. A rock drill bit as defined in claim 5 wherein said bit includes reamer cutter slots which extend lengthwise of said bit and cutter baase therein, said reamer cutter slots and the reamer cutter bars received thereby each having cooperating converging side wall configurations for holding the reamer cutter bars in their receiving slots, and wedge means in the bottom of each of said reamer cutter slots, for wedging said reamer cutter bars radially outwardly of the axis of the drill bit to lock the reamer cutter bars in the slots.

26. A rock drill bit as defined in claim 25 wherein said wedging means for said reamer cutter bars comprises a pair of cooperating oppositely tapered wedges.

27. A rock drill bit as defined in claim 5 comprising a body section and a removable bit head on said body section for mounting said first cutter bars and including reamer slots which extend lengthwise of said bit head and open into said slots which receive said first cutter bars, reamer cutter bars received in said reamer slots and said reamer slots and cutter bars received thereby each having cooperating configurations including a dovetail side wall converging toward the opposite wall of each for holding the reamer cutter bars in their receiving slots, and wedge means between the bottoms of said reamer slots and the reamer cutters therein wedging said reamer cutter bars radially outwardly of the axis of the drill bit to trap the reamer cutter bars in the slots.

28. A rock drill bit as defined in claim 25 wherein said wedging means for said reamer cutter bars comprises cooperating oppositely tapered wedges.

29. A rock drill bit as defined in claim 10 having a core cutter disposed on the axis of said bit in said central passage and said cutter bars comprising cutter bars having their inner ends underlying said central passage but spaced from each other whereby a core attached to the bottom of a hole face is formed as the drilling proceeds, said core cutter being rotatable with the bit and positioned to engage the core formed on the bottom face to cut the top of the core as the drilling proceeds.

30. A rock drill bit as defined in claim 29 wherein a collet chuck is wedged in said central passage for supporting said core cutter with said cutter projecting into an enlarged chamber of said central passage about said core cutter.

31. A rock drill bit as defined in claim 30 in which said bit has a body comprising a body section and a removable bit head and said enlarged chamber is a chamber between said body section and bit head with said collet chuck being wedged in the central passage of said body section.

32. A rock drill bit as defined in claim 30 in which said collet chuck is formed of resilient bronze.

33. A rock drill bit as defined in claim 30 wherein said collet chuck has a conically tapered end portion at its upstream end and passageways for mud fluid in the exterior thereof extending axially of the chuck.

34. A rock drill bit as defined in claim 29 wherein said core cutter has helical flutes extending away from the leading end of the bit, the core cutter including a plurality of cutter edges on the leading end thereof which extend outwardly from the axis of the core cutter along edges of walls formed by said flutes.

35. A rock drill bit as defined in claim 30 wherein said core cutter has helical flutes extending away from the leading end of the bit and a plurality of cutting edges extending from the axis at the leading end of the cutter along edges of walls formed by said flutes.

36. A rock drill bit as defined in claim 33 wherein said end portion of said chuck has a spherically curved surface at its apex.

37. A rock drill bit as defined in claim 30 wherein the diameter of said central passage downstream of said chuck is smaller than the diameter of the downstream end of said collet chuck.

38. A rock drill bit as defined in claim 5 or 27 wherein wedging surfaces of said wedge members and the surfaces contacting the wedging surfaces have a roughened finish.

39. A rock drill bit as defined in claim 27 wherein a clamp ring bolted to the body of the drill bit engages and clamps against uppermost ends of the uppermost reamer cutter bars, and a threaded ring member engages and locks the bolted clamp ring against backoff.

40. A rock drill bit as defined in claim 10 wherein said cutter bars comprise coring cutter bars having portions which terminate in a shaving edge which extends generally axially of the bit for shaving a hole core.

41. A rock drill bit rotatable about an axis for drilling a hole comprising means on the leading end of the bit for drillng against the hole bottom and forming a core as the drilling proceeds, a core shaver having radially extending shaving edges for engaging said core mounted on the axis of said bit at the leading end thereof for shaving the top of the core on rotation of the bit, a central passage opening into the leading end face of the bit for delivering drilling mud to the bottom of the hole, said core shaver being mounted in said central passage and projecting into an enlarged portion of said central passage for receiving the core, a collet chuck for receiving and holding said core shaver in said central passageway, the diameter of said central passage downstream of said chuck being smaller than the diameter of the downstream end of said collet chuck.

42. A rock drill bit as defined in claim 41 in which said collet chuck is formed of resilient bronze.

43. A rock drill bit as defined in claim 41 wherein said collet chuck has a conically tapered end portion terminating in a spherically curved portion at its upstream end.

44. A rock drill bit as defined in claim 41 wherein said core shaver has helical flutes extending away from the leading end thereof, said cutting edges being along edges of walls formed by said flutes.

45. A rock drill bit rotatable about an axis for drilling a hole, said drill bit having a central passage for delivering drilling mud to the leading end of the bit, said central passage having a venturi configuration with a venturi throat area, a plurality of mud ports opening into the outer periphery of the bit, said ports being spaced angularly about the bit and lengthwise of the bit, lateral passageways extending downwardly from said mud port to open into said central passage with said lateral passageways comprising a group of lateral passageways intersecting said central passage adjacent the throat of said venturi.

46. A rock drill bit as defined in claim 45 wherein a plurality of second passageways intersect said central passage upstream of said venturi throat and extend downwardly therefrom at a shallow angle to said central passage for delivering drilling mud to the leading end of the bit, each of said lateral passageways intersecting one of said second passageways.

47. A rock drill bit as defined in claim 45 or 46 wherein said lateral passageways comprise second and third groups of lateral passageways respectively communicating with said central passage upstream of said throat and downstream thereof.

48. A rock drill bit rotatable about an axis for drilling through geological formations comprising a body having a cylindrical configuration for substantially the full length of the bit, a first end portion to be connected to a drill string and a second end portion which leads the bit on drilling, said second end portion having a leading end face, said body having a plurality of reamer cutter bar slots in its outer periphery arranged angularly about the bit axis and extending generally parallel thereto and reamer cutter bars wedged in said slots for working on the wall of the drill hole for substantially the full length of the cylindrical configuration of said body, said body having a central passage for delivering drilling mud to the leading end face of the bit, and drilling mud ports between adjacent ones of said reamer cutter bars communicating with said central passage, bottom cutter elements for operating on the bottom of the hole being mounted on the leading end of said body, said bottom cutter elements having cutting edges arranged along lines extending crosswise of said axis and being arranged angularly about said axis.

49. A rock drill bit as defined in claim 48 wherein said bottom cutting elements are received in bottom slots opening into the leading end face of said body and which are arranged about an outlet in said leading end face for said central passage.

50. A rock drill bit as defined in claim 49 wherein said bottom cutting elements and the slots receiving the cutter elements have converging side walls with the side walls of the slots diverging inwardly from the leading end face of said body to a slot bottom extending crosswise of said axis, and wedging means between the bottom cutter elements and the bottoms of their receiving slots to wedge said bottom cutter elements against the side walls of the slots.

51. A cutter bar for a rock drill bit and adapted to work on the bottom of a drill hole, said cutter bar having a bottom side, opposed sides converging toward each other from said bottom side, a relief side opposed to said bottom side and extending between said converging sides, one of said converging sides forming a leading severing face for the cutter bar and said relief side extending at a relief angle from the severing face, said cutter bar having a first severing edge along a straight line at the intersection of said leading severing side and said relief side and said cutter bar terminating in opposed end sides with one of said end sides and said leading severing side having a severing second edge along the line of the intersection of the sides for shaving a hole formation extending axially of the hole.

52. A cutter bar as defined in claim 51 wherein the severing edges of said cutter bar comprise a shaving edge at the intersection on one of said end sides with said severing face for shaving a side of a core formed while drilling, the portion of said severing face adjacent said shaving edge for a core having a negative rake angle between said portion of the severing face and said relief side.

53. A cutter bar as defined in claim 51 wherein said coverging sides, bottom sides and relief side are comprised of essentially planar surfaces.

54. A cutter bar as defined in claim 52 wherein said severing face has a positive rake angle for the portion thereof from said portion adjacent said shaving edge to the other end of the cutter bar.

55. A cutter bar as defined in claim 51 wherein the severing edges of said cutter bar comprise a gauge edge at the intersection of one of said end sides and said severing face for working on the hole wall with the end side forming said gauge edge extending away from the gauge edge at an angle to the severing face smaller than the curvature of the hole wall to provide a relief surface.

* * * * *

UNITED STATES PATENT AND TRADEMARK OFFICE

CERTIFICATE OF CORRECTION

PATENT NO. : 4,445,580
DATED : May 1, 1984
INVENTOR(S) : Lloyd W. Sahley

It is certified that error appears in the above-identified patent and that said Letters Patent are hereby corrected as shown below:

Column 18, line 8, after "drill" insert - - bit - -.

Column 20, line 38, change "baase" to - - bars - -.

Column 21, line 10, insert - - core - - before "cutter" second occurrence.

Column 23, line 17, change "severing second" to - - second severing - -.

Signed and Sealed this

*Second* Day of *October 1984*

[SEAL]

*Attest:*

GERALD J. MOSSINGHOFF

*Attesting Officer*

*Commissioner of Patents and Trademarks*